US010593312B1

(12) United States Patent
Kasahara

(10) Patent No.: US 10,593,312 B1
(45) Date of Patent: Mar. 17, 2020

(54) DIGITAL MUSICAL SYNTHESIZER WITH VOICE NOTE IDENTIFICATIONS

(71) Applicant: Masaaki Kasahara, Sunnyvale, CA (US)

(72) Inventor: Masaaki Kasahara, Sunnyvale, CA (US)

( * ) Notice: Subject to any disclaimer, the term of this patent is extended or adjusted under 35 U.S.C. 154(b) by 0 days.

(21) Appl. No.: 16/294,584

(22) Filed: Mar. 6, 2019

Related U.S. Application Data

(60) Provisional application No. 62/639,852, filed on Mar. 7, 2018.

(51) Int. Cl.
*G10H 1/20* (2006.01)
*G10H 1/00* (2006.01)

(52) U.S. Cl.
CPC ..... *G10H 1/0066* (2013.01); *G10H 1/0008* (2013.01); *G10H 2210/066* (2013.01)

(58) Field of Classification Search
CPC ..... G10H 1/0066; G10H 2240/145; G10H 2240/056; G10H 2210/145; G10H 2240/071; G10H 2210/151; G10H 1/0041; G10H 2240/311; G10H 1/38; G10H 2210/616; G10H 2220/201; G10H 2210/101; G10H 2240/125; G10H 2250/615; G10H 2210/155; G10H 2210/071
See application file for complete search history.

(56) References Cited

U.S. PATENT DOCUMENTS 5,783,767 A * 7/1998 Shinsky ..... G10H 1/0025 84/613
5,890,115 A * 3/1999 Cole ..... G10H 7/02 704/258
6,191,349 B1 * 2/2001 Flam ..... G10H 1/0066 84/609
2004/0206226 A1 * 10/2004 Negoescu ..... G10H 7/006 84/600
2010/0306680 A1 * 12/2010 Quennesson ..... G06F 8/38 715/763
2015/0268926 A1 * 9/2015 Panaiotis ..... G06F 3/167 715/716

* cited by examiner

*Primary Examiner* — Marlon T Fletcher

(57) ABSTRACT

A method for generating voice note identifications for digital musical instrument note controlling signals. The method provides voice identification for every note in digital interface, which makes music learning intuitive and easier. The method can be used with a majority of digital instruments as a part of such instruments. Solfege is used as voice note identification system since it is widely used in music education. However, any such system can be used or newly devised by preparing a different set of patches.

10 Claims, 4 Drawing Sheets

MIDI Control Logics

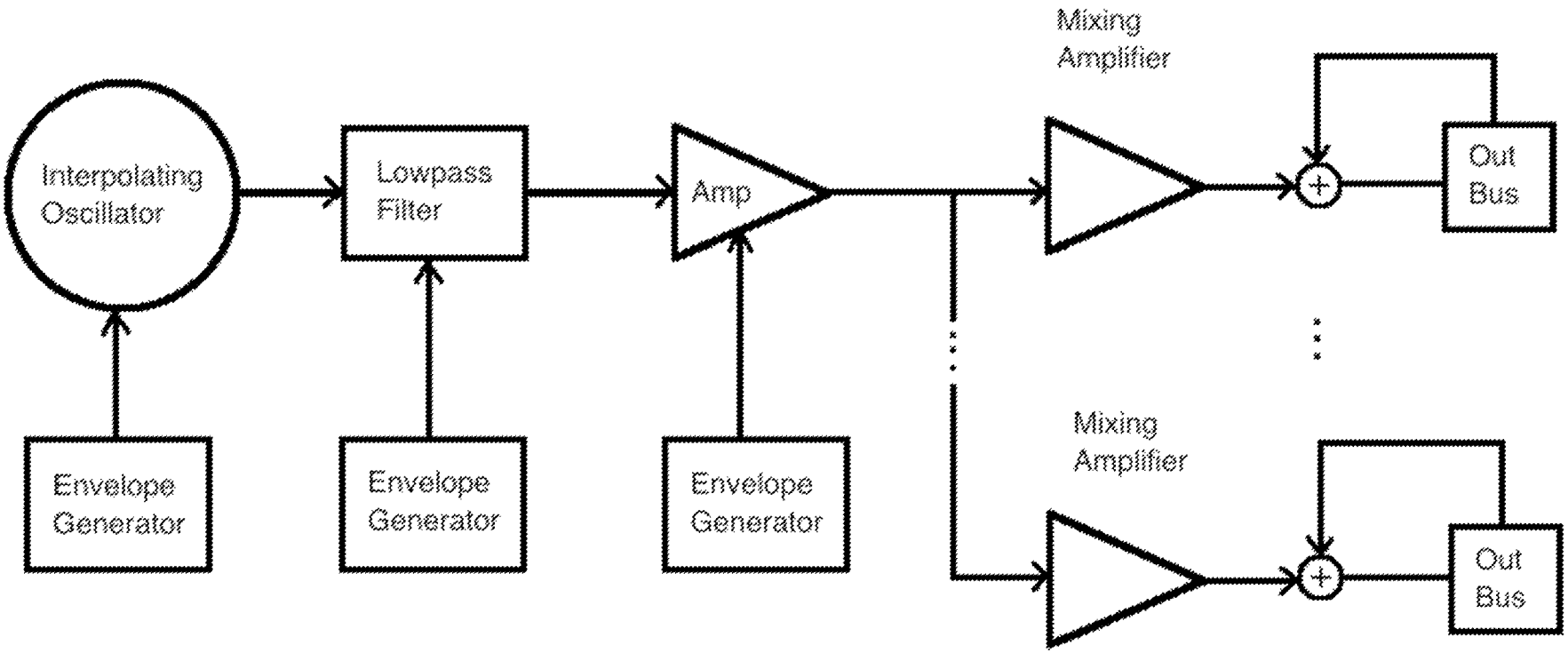
Fig. 1. EMU10K1 Wavetable Synthesizer

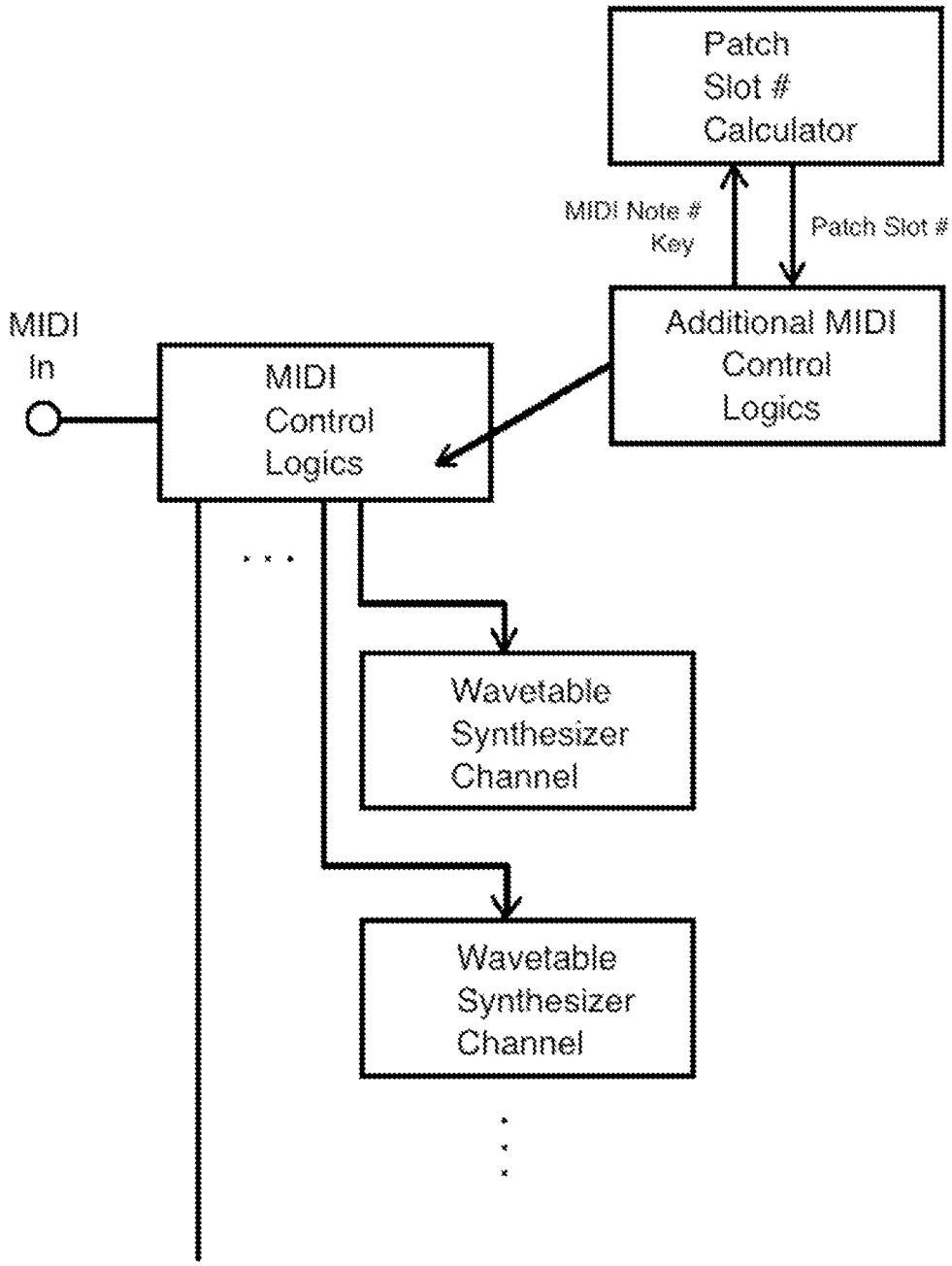
Fig. 2 MIDI Control Logics

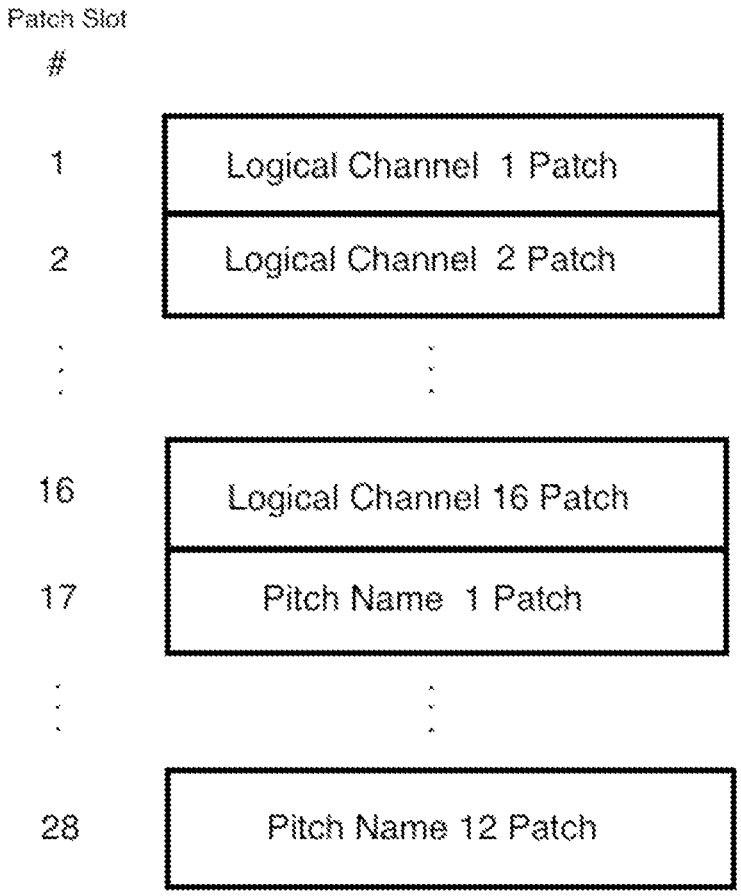
Fig. 3 Patch Areas

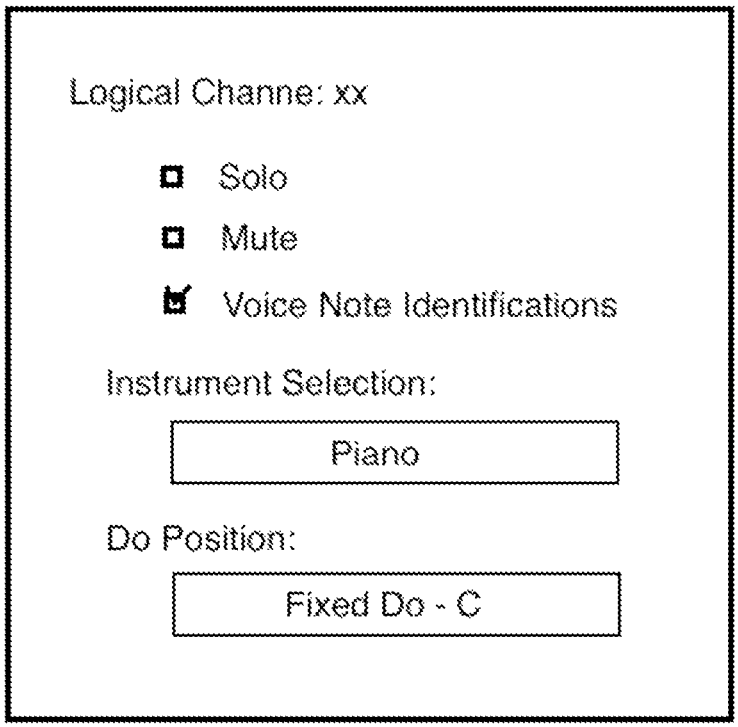
Fig. 4 Typical User Interface

DIGITAL MUSICAL SYNTHESIZER WITH VOICE NOTE IDENTIFICATIONS

CROSS-REFERENCE TO RELATED APPLICATIONS

This application claims the benefit of provisional patent application No. U.S. 62/639,852 filed Mar. 7, 2018 by the present inventor.

FIELD OF THE INVENTION

The present invention relates generally to digital musical synthesizers, and specifically to methods and devices for representing musical notes using a digital interface.

BACKGROUND OF THE INVENTION

The author described a method to add voice note identifications in his patent (U.S. Pat. No. 9,997,147). The method utilizes a present GM (General MIDI) compliant wavetable synthesizer. It is easy to implement the idea. However, it is not suitable to use it across all the logical channels of such a synthesizer. This is due to the fact that the invention needs 12 unused Logical Channels for every Logical Channel, which requires voice note identifications. Simply put, we need additional 16×12 unused Logical Channels to use it on all the 16 Logical Channels. It is not impossible, but impractical. There are also cases where the idea needs to be implemented in non-MIDI digital synthesizers or MIDI compliant, yet non-wavetable synthesizers.

In order to overcome the limitation imposed by his original patent, he developed a new method. The new method taps into how each MIDI Note On/Off signals are used inside of a GM compliant wavetable synthesizer. Although the new method brings a great deal of flexibilities, it has a drawback as well. It has to be implemented inside of such a synthesizer, which requires customizations.

Digital interface is used for a majority of today's musical instruments whether it complies with MIDI (Musical Instrument Digital Interface) or not. This means digital musical instruments are controlled in a similar fashion. With such instruments, this invention can be used to add voice note identifications. In this application, MIDI is used for the sake of the explanation, but most of the digital interface can be treated in the same manner. If not, simply this invention is not applicable. For the sake of discussions, MIDI is explained below.

MIDI is a standard known in the art that enables digital musical instruments and processors of digital music, such as personal computers and sequencers, to communicate data about musical notes, tones, etc. Information regarding the details of the MIDI standard is widely available.

MIDI files and MIDI devices which process MIDI information designate a desired simulated musical instrument to play forthcoming notes by indicating a patch number corresponding to the instrument. Such patch numbers are specified by the GM protocol, which is a standard widely known and accepted in the art.

According to GM, 128 sounds, including standard instruments, voice, and sound effects, are given respective fixed patch numbers, e.g., Acoustic Grand Piano=1. When any one of these patches is selected, that patch will produce qualitatively the same type of sound, from the point of view of human auditory perception, for any one key on the keyboard of the digital musical instrument as for any other key varying essentially only in pitch.

MIDI allows information governing the performance of 16 independent simulated instruments to be transmitted simultaneously through 16 logical channels defined by the MIDI standard. Of these channels, Channel 10 is uniquely defined as a percussion channel, which has qualitatively distinct sounds defined for each successive key on the keyboard, in contrast to the patches described hereinabove.

Note: In 1992, with the introduction of the Creative Labs Sound Blaster 16, the term "wavetable" started to be (incorrectly) applied as a marketing term to their sound card. Strictly speaking, it should be called "Sample based" synthesizer. In this application, the term "wavetable" is also used as "Sample based" following the current convention.

In modern western music, we employ so-called equal temperament tuning system where we divide one octave into 12 equally divided pitches. We use terms such as C, C #/D flat, . . . , B to indicate which one of the 12 pitches to be used. In every octave, we observe the repeat of the same sequence.

We also have a Solfege syllable assigned to each pitch name described hereinabove. For example, Do is used to indicate C. All Solfege syllables correspond to C notes sound qualitatively the same except for the feeling of higher/lower registers.

We use Solfege in music education because it enables us to sing a tune with pitch information. In theory, it is possible to use pitch names, such as C, D, etc. In practice, however, it is inconvenient to employ longer syllables for fast passages.

There are actually two kinds of Solfege in use today. One is called Fixed Do System, and the other Movable Do System. As the names suggest, you do not move the starting point Do in Fixed Do System whereas you move the starting point Do, sometimes called root note, in Movable Do System according to the key you are in.

SUMMARY OF THE INVENTION

It is an object of some aspects of the present invention to provide improved devices and methods for utilizing digital music processing hardware.

It is an object of some aspects of the present invention to provide devices and methods for generating voice note identifications with digital music processing hardware.

BRIEF DESCRIPTION OF THE DRAWING

FIG. 1 shows one of the channels found in a wavetable based musical synthesizer, using EMU10K1 as an example.

FIG. 2 shows original MIDI Control Logics and additional MIDI control logics for the invention.

FIG. 3 shows Patch Areas for both 16 original instrument patches and 12 Pitch Name Patches for the invention. For the sake of brevity, each logical channel employs single voice called a layer.

FIG. 4 is a typical User Interface including switches for the invention.

DETAILED DESCRIPTION OF THE INVENTION

FIG. 1 shows a typical wavetable synthesizer channel, which generates an instrument sound. The diagram is from E-MU 10k1 chip, one of the most popular designs in the industry. It contains 64 of them. Upon receiving a MIDI Note On signal, MIDI Control Logics assign one of them to produce a corresponding sound as illustrated in FIG. 2. The same scheme is used for all logical channels. The maximum number of polyphonies, different sounds produced at one time, is thus 64. All the patches used for the operation should be loaded into memories before the operation.

The preferred embodiment is to use the invention in a wavetable synthesizer since it also uses wavetable sound synthesis for voice note identifications. There are hardware implementations as well as software implementations. In principle, software synthesizers operate in the same fashion. However, they can be configured or organized in different manners. Because of this, they may appear differently on the surface level.

For example, a GM (General MIDI) synthesizer contains 16 logical channels. In hardware, all of them are processed in the same manner to utilize the same processing cores called channels. Since the maximum number of cores is limited, it is not wise to allocate the same number of cores across all the logical channels because how many cores required for a channel is dependent on a kind of signals to be processed. Therefore, all the signals are processed in the same manner regardless of their logical channel designations.

On the other hand, any number of processes (cores in hardware) can be created for a logical channel in software, limited only by the processing power of a machine. Therefore, there is no need to use the same processing method (or core structure) across all the logical channels. This means software synthesizers are more flexible in terms of their implementations.

Here is the important point: How each MIDI note on/off signal should be processed remains the same regardless of how a synthesizer is organized. Otherwise, it would produce a different result. This is also true for how the voice note identifications should be processed. This is especially important when it comes to the claims. The claims is written based on how each MIDI note on/off signal should be processed regardless of how a synthesizer is organized.

If the underlying synthesizer structure is different, the method for implementing the voice note identifications needs to be changed accordingly. For example, if a synthesizer is organized based on a logical channel rather than a processing core (or channel), the voice note identifications should be implemented based on a logical channel, too. E-MU 10k1 chip, on the other hand, has 64 channels (processing cores) used for all 16 logical channels.

As an example, if the underlying synthesizer is based on a logical channel, layers could be utilized to implement voice note identifications. In general, a voice consists of one or more layers. Layers are usually put together to create more intricate sounds than single layer. They are activated together. Here, 12 shadow layers, which correspond to 12 pitch names, are employed. Shadow means it is not accessible as ordinary layers, but reserved for the voice note identifications. Also, they are not activated together. Instead, only the corresponding layer is activated at a time based on the logics discussed later. This way, the same result is achieved. It is a variation of the original idea.

If the underlying synthesizer is not based on a wavetable synthesizer, the invention can still be used. In this case, prepare a wavetable synthesizer just for the voice note identifications. The original instrument sound should be processed in the subject synthesizer and use the wavetable synthesizer for the voice note identifications as described below.

For the sake of completeness, there is yet another case where instrument sounds are not generated by the underlying synthesizer. For example, a guitar is used to generate MIDI signals through a Guitar to MIDI Converter. Since the guitar generates instrument sounds, obviously guitar sounds in this case, there is no need for generating instrument sounds by the synthesizer.

With all that said, there are two things which need to be added to a base wavetable synthesizer:

1. 12 new patch areas for voice note identifications as shown in FIG. 3.
2. Additional MIDI Control Logics for adding voice note identifications as shown in FIG. 2.

Assuming the based synthesizer has 16 logical channels, there are already 16 patch areas, most likely in memory. The additional 12 patch areas are used for all 16 logical channels for voice note identifications. It is possible to add a different set of voice patches as a multiple of 12. It adds more complexities to the MIDI Control Logics as well as the memory requirement.

This is what happens when a MIDI Note On signal is received: The MIDI Control Logics assign one of wavetable synthesizer channels with one of 16 patches in memory based on its logical channel. It generates a corresponding instrument sound for a given logical channel.

As for the note identifications, the MIDI Control Logics should check if note identifications are turned on for this logical channel (FIG. 4). If yes, it assigns another wavetable synthesizer channel with one of 12 patches in memory designated by Patch Slot Number Calculator (explained later) in FIG. 2. It generates a corresponding voice note identification. It is important to copy all the settings of the logical channel since the voice note identification is for that logical channel. These extra steps need to be added to the original MIDI Control Logics.

Upon receiving a MIDI Note Off signal, the wavetable synthesizer channel for the given instrument is turned off by the original MIDI Control Logics. Additionally, the voice note identification should be turned off by the added logics in the same manner.

Adding voice note identifications increases the CPU load roughly twice when voice note identifications are turned on for all the logical channels. The memory requirement also increases for the additional set of the 12 patches. Additional logics or programs to load the newly added patches are also required. The benefit is that they can be read from anywhere in the system. It can be from a separate patch file because it is already outside of the GM standard. The original patch set can be used without any modification, which should be a good strategy from a usability stand point.

Now, the voice note identification is a part of the original synthesizer. The benefit is that it is controlled in the same manner as the original synthesizer. For example, a pan control will control both its instrument sounds and voice note identifications at the same time. When the invention is utilized in GM (General MIDI) compliant synthesizers, all of their 16 logical channels are equipped with the voice note identifications. Each logical channel can be controlled separately. This is a huge advantage of this invention and especially useful in polyphonic music, such as J. S. Bach's Fugues. By the way, Channel 10 could be excluded since it is generally assigned as a percussion channel. However, many software implementations allow Channel 10 to be used in either way.

The benefit of the original patent (U.S. Pat. No. 9,997,147) is that it is simple and practical without any customization of an existing wavetable synthesizer (Hardware or Software), especially when a software wavetable synthesizer is becoming readily available as a standard in portable devices. In fact, dealing with one instrument with voice note identifications utilizing 12 idling logical channels should be a good idea. However, it is difficult or impossible to use the voice note identifications for more than one logical channel. This invention extends the capability over all the logical channels.

Here is how to implement the Patch Slot Number Calculator in FIG. 2. We have a set of 12 patches because we have 12 different pitch classes. For the sake of brevity, we use the following terms: p1 (Pitch_Name_1), p2, . . . , p12 We also need to use a modulo operator: %. In computing, the modulo operation finds the remainder after a division of one number by another.

$$\text{modulo}=\text{MIDI_note_number} \% 12 \quad \text{(Eq. 1)}$$

Let us take the middle C note, for example. It corresponds to MIDI_note_number: 60. In the equation 1 (Eq. 1), the modulo is 0 since the reminder after division of 60 by 12 is 0. The following is a list of all the cases:

If the modulo is 0, return p1, which is 0+offset.
If the modulo is 1, return p2, which is 1+offset.
If the modulo is 2, return p3, which is 2+offset.
If the modulo is 3, return p4, which is 3+offset.
If the modulo is 4, return p5, which is 4+offset.
If the modulo is 5, return p6, which is 5+offset.
If the modulo is 6, return p7, which is 6+offset.
If the modulo is 7, return p8, which is 7+offset.
If the modulo is 8, return p8, which is 8+offset.
If the modulo is 9, return p9, which is 9+offset.
If the modulo is 10, return p10, which is 10+offset.
If the modulo is 11, return p11, which is 11+offset.

The offset value is 17, which is required to select a corresponding patch shown in FIG. 3. This approach makes it easy to implement the additional logics to the MIDI Control Logics since both instrument and voice note identification patches can be addressed in the same manner. Please note that how each patch should be addressed is implementation-dependent. For the sake of brevity, each logical channel employs single voice (or single layer). The offset value and/or addressing method should be changed according to a particular implementation.

Pitch_Name_1 is Do when Solfege is used as voice note identification system. However, Solfege is not the only option for voice identifications. It is a widely used convention in music education. Any such system can be used with the invention, or even new system can be devised by preparing a different set of patches.

The system described up to this point only works with Fixed (Do) System. In order to make the system capable of Movable (Do) System, a new integer variable, Key, is introduced. By simply replacing the original equation (Eq. 1) with the following equation (Eq. 2), it is possible to shift the root note.

$$\text{modulo}=(\text{MIDI_note_number}-\text{Key}) \% 12 \quad \text{(Eq. 2)}$$

The value of Key should be between 0 and 11. The root note can be chosen among any one of 12 keys. For example, using 0 for Key, the root note is C, which is the same as Fixed (Do) System. Using 1 makes it C #/D flat. You can shift the key all the way to 11, which is B, by the way. Generally, the value of Key can be changed through the user interface shown in FIG. 4.

The above explanation is prepared for a digital interface complying MIDI specifications. However, most of the digital interface operates in the similar manner. It should be easy to modify the logics to adapt for special cases.

The invention claimed is:

1. A method for electronic generation of sounds, based on notes in a musical scale, comprising:

assigning respective sounds to said notes, such that each sound is perceived by a listener as qualitatively distinct from a sound assigned to an adjoining note in said musical scale;

adding 12 new patch areas for voice note identifications and additional MIDI Control logics to a base wavetable synthesizer in order to generate an additional voice note identification signal for a MIDI note signal received while finding Pitch Name Number by subtracting a variable from a MIDI note number of said MIDI note signal, then taking a modulo by 12 while using 0 for C, 1 for C #/D flat, 2 for D, 3 for D #/E flat, 4 for E, 5 for F, 6 for F #/G flat, 7 for G, 8 for G #/A flat, 9 for A, 10 for A #/B flat and 11 for B as said variable;

additionally creating said MIDI note signal with a corresponding Patch slot number where Pitch Name Number=0 for C Patch Set, 1 for C #/D flat Patch Set, 2 for D Patch Set, 3 for D #/E flat Patch Set, 4 for E Patch Set, 5 for F Patch Set, 6 for F #/G flat Patch Set, 7 for G Patch Set, 8 for G #/A flat Patch Set, 9 for A Patch Set, 10 for A #/B flat Patch Set and 11 for B Patch Set whereby utilizing Solfege for the patches, a position of Do is changeable to support a Movable Do System;

receiving an input indicative of a sequence of said notes, chosen from among said notes in said musical scale; and generating an output responsive to said sequence of received said notes, in which said qualitatively distinct sounds are produced responsive to respective notes in said sequence at respective musical pitches associated with said respective notes.

2. A method according to claim 1, wherein at least one of said qualitatively distinct sounds comprises a representation of a human voice.

3. A method according to claim 2, wherein said qualitatively distinct sounds comprise solfege syllables respectively associated with said notes, or newly created syllables respectively associated with said notes.

4. A method according to claim 1, wherein said patches comprise: generating a digital representation of said sounds by digitally sampling said qualitatively distinct sounds; and saving said digital representation in said patches.

5. A method according to claim 1, wherein said receiving said input comprises playing said sequence of notes on a musical instrument.

6. A method according to claim 1, wherein said receiving said input comprises retrieving said sequence of notes from a file.

7. A method according to claim 6, wherein said retrieving comprises accessing a network and downloading said file from a remote computer.

8. A method according to claim 1 wherein said qualitatively distinct sounds comprise sounds which differ from each other based on a characteristic that is separate from a pitch of each of said sounds.

9. A method according to claim 1 wherein said wavetable synthesizer can be omitted for an instrument sound if said instrument sound is generated by a separate synthesizer or said instrument sound is unnecessary.

10. A method according to claim 1 wherein said MIDI signal may be replaced with a similar digital control signal.

* * * * *